US005732909A

United States Patent [19]

Sonnier

[11] Patent Number: 5,732,909

[45] Date of Patent: Mar. 31, 1998

[54] PIPE GRIPPING SYSTEM AND METHOD

[75] Inventor: Errol A. Sonnier, Broussard, La.

[73] Assignee: Carlos A. Torres, Houston, Tex.

[21] Appl. No.: 670,640

[22] Filed: Jun. 26, 1996

[51] Int. Cl.[6] ..... F16L 3/18

[52] U.S. Cl. ..... 248/49; 248/58; 248/74.1; 248/316.2; 248/316.3; 166/209

[58] Field of Search ..... 248/49, 58, 74.1, 248/316.2, 316.3; 166/209, 210, 215, 318, 348

[56] References Cited

U.S. PATENT DOCUMENTS

| | | | |
|---|---|---|---|
| 2,676,036 | 4/1954 | Arrowood | 248/49 X |
| 2,683,046 | 7/1954 | Allen | 248/49 X |
| 2,887,754 | 5/1959 | Johnson | 166/209 X |
| 3,127,198 | 3/1964 | Orund | 248/49 X |
| 4,202,090 | 5/1980 | Cook | 248/49 X |
| 5,042,756 | 8/1991 | Pratt, Jr. | 248/49 |
| 5,120,009 | 6/1992 | Sasin | 248/74.1 X |
| 5,163,642 | 11/1992 | Torrens et al. | 248/49 |

FOREIGN PATENT DOCUMENTS

| | | | |
|---|---|---|---|
| 3938813 | 5/1991 | Germany | 248/49 |

*Primary Examiner*—Carl D. Friedman
*Assistant Examiner*—W. Glenn Edwards
*Attorney, Agent, or Firm*—Carlos A. Torres

[57] ABSTRACT

A slip die with a substantially smooth pipe contact surface is employed in a conventional slip assembly as a primary mechanism for gripping pipe. A second conventional slip assembly with conventional dies having penetrating die teeth on their contact surfaces is employed as a secondary gripping mechanism to automatically grip the pipe in the event the primary mechanism loses its grip. The smooth slip elements are constructed of a malleable material which tends to conform to surface irregularities on the outer surface of the pipe to increase the gripping force on the pipe. In the method, the pipe is initially gripped by the primary slip mechanism before the secondary mechanism is actuated to contact the pipe. The slips are set by downward pipe forces acting on the dies so that the die teeth of the secondary mechanism do not grip the pipe unless the primary slip mechanism fails. The system and method permit the pipe to be gripped without producing damaging die teeth marks on the pipe during normal pipe handling operations while providing a secondary mechanism which will automatically grip the pipe if the primary gripping mechanism fails.

22 Claims, 1 Drawing Sheet

FIG. 1
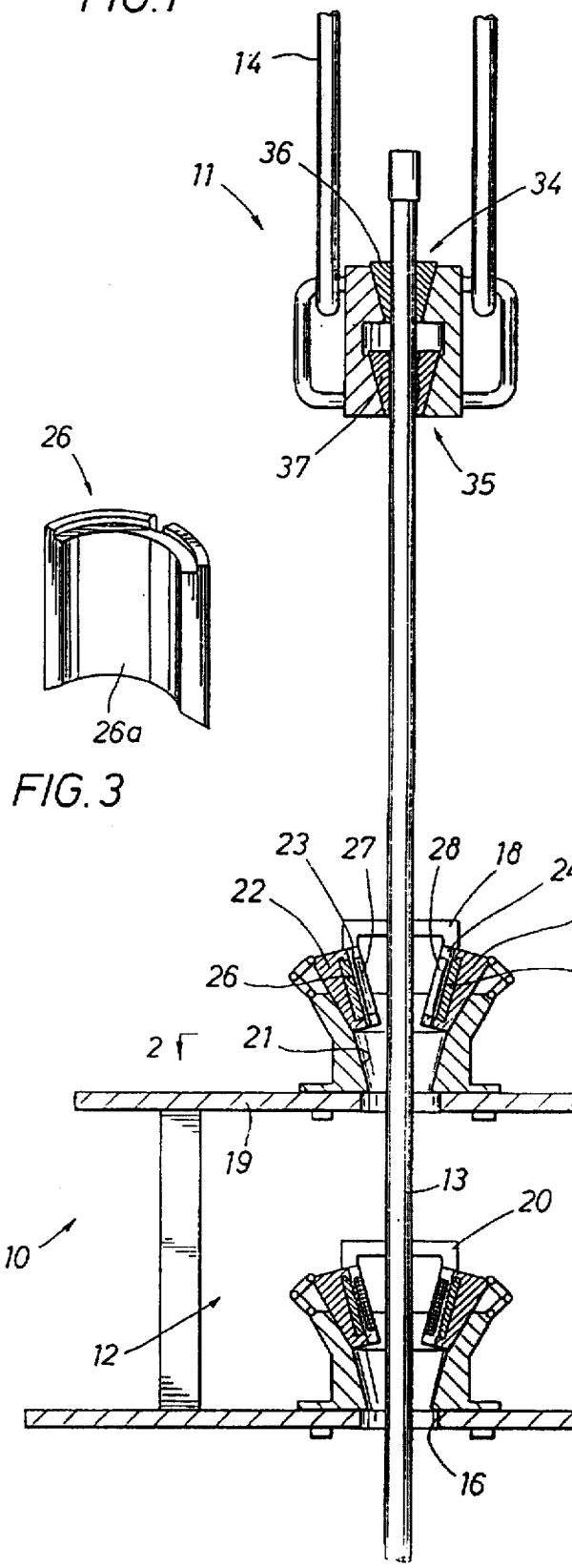
FIG. 2
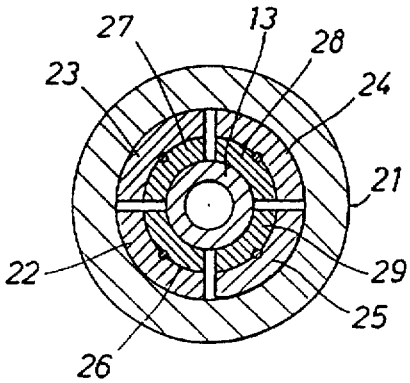
FIG. 3

PIPE GRIPPING SYSTEM AND METHOD

This application is related to U.S. patent application Ser. No. 08/670,639 entitled Pipe Gripping Assembly and Method invented by Carlos A. Torres and filed contemporaneously with the present application.

BACKGROUND OF THE INVENTION

The present invention relates generally to a system and method for handling pipe that is to be run into or pulled from a well. More specifically, the present invention relates to a system and method for gripping such pipe without damaging the pipe's outer surfaces while simultaneously providing a secondary gripping mechanism that automatically actuates to grip the pipe if the pipe slips through the primary gripping mechanism.

BRIEF DESCRIPTION OF THE PRIOR ART

Slip assemblies are customarily employed to temporarily grip and hold pipe as it is being run into or pulled from a well. In a conventional slip assembly, tapered slips, which are carried in a tapered slip bowl, are "set" into gripping engagement with the pipe extending through the center of the bowl by moving the slips into contact with the pipe and then slightly lowering the pipe to allow the slips to support the pipe weight. The surface friction between the slips and the pipe causes the slips to move with the pipe, which pushes the tapered slips axially downwardly into the tapered slip bowl. This relative movement between the tapered slips and the tapered bowl forces the slips radially toward each other to grip the pipe extending through the center of the assembly. As the weight of the string increases, the downward force on the slips increases, which, in turn, acts through the engaged tapered surfaces to increase the radial pipe gripping force exerted by the slips. The slips are released by first lifting the string to relieve the weight on the slips and then retracting the slips out of engagement with the pipe.

The slips are typically equipped with replaceable, steel slip-dies that contact and grip the pipe. Conventional steel dies are typically equipped with radially projecting teeth that are designed to penetrate the outer pipe surface to increase the gripping force of the slips. The usual slip setting procedure can produce die-tooth cuts in the pipe surfaces that decrease the thickness and structural strength of the pipe, provide a corrosion attack point, and otherwise detrimentally affect the pipe.

Efforts at reducing the scarring caused by die teeth include the use of slip dies with very small teeth or specially configured teeth or, in some cases, with no teeth at all. While the prior art designs produce reduced pipe damage, as compared with conventional steel toothed-dies, a primary problem with these designs is that the slips can sometimes fail to grip the pipe securely and thus permit the string to slide through the slip assembly. The problem is most likely to occur as the string weight increases or when the slip teeth become clogged with debris or when the string or slips are contaminated with oil or other slippery substances.

If the pipe string slides through the dies, in many cases, the downward slide is stopped suddenly when a pipe coupling at the end of a pipe joint engages the slip assembly. Such slippage is objectionable in that it allows the string to be mispositioned, and also damages the pipe surface as the pipe slides through the slips. Moreover, if the impact of the coupling striking the slip assembly is strong enough, the pipe may be knocked free of the coupling allowing the string to fall into the well.

One prior art design, described in U.S. Pat. No. 3,579,753, describes a smooth die system that employs a special die carriage design to increase the radial die forces acting on the pipe. The patented system requires a relatively complicated slip carrier design that can be expensive to produce and maintain. No provision is made in the patented system for preventing pipe slippage if the smooth die slips should malfunction.

Other prior art devices for holding pipe without damaging the pipe surface have generally included complex mechanisms that are expensive to build and maintain. These prior art devices also lack an effective backup holding mechanism to prevent pipe movement if the primary holding device fails.

SUMMARY OF THE INVENTION

Smooth, toothless slip-dies are used in a conventional tapered-bowl, slip anchoring device as a primary assembly for gripping the pipe. A secondary conventional anchoring device, with standard toothed dies, is used as a backup assembly to automatically grip the pipe if the pipe slips through the primary assembly.

In a preferred embodiment, a relative soft, aluminum alloy is employed for the slip dies so that the closing forces of the slip assembly cause the dies to conform to the outer surface of the harder pipe to thereby enhance the gripping force of the primary slip assembly. When the assembly is used with fiberglass pipe and other very soft pipe, die materials harder than the pipe material may advantageously be used.

In operation, the slips of the primary assembly are placed against the pipe string and the string weight is transferred to the aluminum slips to set the slip assembly. Once the primary assembly has been set, the slips of the secondary assembly may be closed to allow the steel toothed-dies to contact the pipe. When the primary assembly is operating properly, the pipe string will be stationary with the entire string weight supported by the primary assembly. While the string is stationary, the steel dies of the backup assembly are in contact with the pipe but are not set and therefore exert virtually no radial force on the pipe. If the string should slip through the closed primary dies, the downward motion of the string will pull the steel dies of the secondary assembly down into the slip bowl, which will force the dies to move radially into firm gripping engagement with the pipe to thereby set the secondary assembly to prevent any continued downward string movement.

Under normal operating conditions, the pipe will be firmly held by the primary slip assembly. On rare occasions, however, the primary assembly may allow the pipe to move after the assembly has been set. On these rare occasions, actuation of the secondary or backup slips to stop the string slippage may produce external marking on the pipe. This damage can, however, be repaired or, if necessary, the damaged joint may be extracted from the string and replaced with a new joint.

One of the advantages of the design of the present invention is that the secondary system and the primary system share the string weight when pipe slippage occurs. As a result, the amount of penetration produced by the teeth of the secondary system is substantially less than is normally produced where the full string weight is acting on the toothed-slips. Moreover, because the secondary slips are engaged and operate immediately at the first onset of string slippage, the pipe does not have an opportunity to increase its falling speed. As a result, the impact of the secondary slips in the tapered bowl is held to a minimum, which further reduces the likelihood of damage to the pipe.

The slippage of the pipe through the primary slip assembly may result, for example, from the presence of oil, or grease, or other debris located between the primary slips and the pipe. Once the cause of the slippage is corrected, the system may be reinitiated to continue running the pipe.

From the foregoing it will be understood that an important object of the present invention is to provide a pipe gripping system that does not damage the external surface of the pipe.

A related object of the invention is to provide a system in which conventional slip assemblies, using non-conventional, smooth-surface dies, are used with conventional slip assemblies using conventional, toothed dies. The two assemblies are employed together to reliably grip and hold fragile well pipe without, in most cases, harmfully damaging the pipe and without the risk of dropping the pipe into the well.

An important object of the present invention, when running metal pipe, is to employ a smooth, toothless slip-die of relatively soft material so that, as the weight of a pipe string increases, the die will increasely conform to surface irregularities in the pipe and increase the gripping force between the slip die and the pipe.

Another object of the present invention is to provide a fail-safe backup that ensures the pipe string will not be dropped into the well if the primary pipe gripping mechanism should fail. It is thus an object of the invention that the backup pipe-gripping assembly function without damage to the pipe during normal operation and only be actuated in the event of pipe slippage through the primary gripping system.

A general object of the present invention is to provide primary and secondary pipe-holding mechanisms wherein the secondary mechanism is automatically actuated to hold the pipe when the pipe slips through the primary mechanism.

These and other objects of this invention will be understood from the following description taken with reference to the attached drawings.

BRIEF DESCRIPTION OF THE DRAWINGS

FIG. 1 is a vertical elevation, partially in section, illustrating the pipe gripping system of the present invention;

FIG. 2 is a partial, horizontal cross sectional view taken along the line 2—2 of FIG. 1, illustrating the primary gripping system of the present invention in set position; and FIG. 3 is a vertical elevation illustrating details in the construction of a smooth-face die insert used in the primary gripping system of the present invention.

DESCRIPTION OF THE PREFERRED EMBODIMENTS

The pipe gripping assembly of the present invention is illustrated generally at 10 in FIG. 1. The assembly 10 includes a movable slip assembly 11 and a stationary slip assembly 12 that operate to selectively grip, hold, release and raise or lower a pipe string 13.

The movable slip assembly 11 is attached to conventional elevator links 14, which, in turn, are connected to a conventional block (not illustrated) that moves up and down in the derrick (not illustrated).

The stationary slip assembly 12 is employed with a work structure 15 that is positioned about a central floor opening 16 formed in a floor 17 of a conventional drilling or workover rig. The stationary assembly 12 includes a primary slip assembly 18 supported on an upper work structure floor 19 and a secondary slip assembly 20 positioned on the rig floor 17. The assembly 20 is aligned below the assembly 18 such that both assemblies are positioned to grip the pipe 13 extending through the central floor opening 16.

The primary slip assembly 18, illustrated in its open condition, includes a tapered slip bowl 21 and multiple tapered slip elements 22, 23, 24 and 25. When the assembly is in its closed condition, the tapered slip elements are forced to move radially as they move axially within the bowl 21 to provide an increasingly greater radial pipe gripping force with increasing pipe string weight. As thus far described, the assembly 18 is of conventional design and operation.

Each of the slip elements 22, 23, 24 and 25 carries, respectively, a slip die 26, 27, 28, and 29 of the present invention which is devoid of die teeth or other significant surface irregularity in the pipe contact area. As best illustrated in FIG. 2, the four dies 26–29 cooperate to substantially completely encircle the pipe to maximize the circumferential surface contact area between the pipe and the dies. When used for running chrome alloy and other relatively soft, metal pipe, the dies 26–29 are preferably constructed of a material that is malleable and can be deformed into the surface irregularities of the pipe as the radial gripping forces are increased to improve the grip of the smooth surface dies with the pipe. When used for running non-metal pipe, however, the die may preferably be constructed of a material that is harder than the pipe material. In any event, the material of construction of the die may be selected as a function of the pipe material and the pipe string weight to optimize system performance. Thus, the die material for fiberglass pipe may also preferably be an aluminum alloy even though the aluminum alloy is harder than the pipe material.

FIG. 3 illustrates details in a smooth or toothless die 26 which may be employed in a conventional sip assembly as described herein. The die 26 includes a curved pipe contact surface **26*a* that has a curvature matching the outer surface of the pipe 13. In a preferred embodiment, the die 26 has a circumferential development of approximately 90° so that four such dies provide almost 360° coverage of the pipe circumference. Maximum contact surface between the slip die 26 and pipe is desired to obtained optimum gripping force. Except for the material of construction and the absence of teeth, the die 26** is similar to a conventional replaceable die employed in conventional slip assemblies.

In one embodiment of the system and method of the invention, dies constructed of 6061-T6 bare aluminum in a "full circle" pattern having a tensile strength of 45,000 psi and a yield strength of 40,000 psi were used in a manually operated Cavens Model "C" spider for the primary slip assembly 18. The pipe being run into the well was a 13% chrome alloy.

The secondary slip assembly 20, which is conventional in all respects, includes conventional steel dies 30,31,32, and 33 with die teeth formed on their pipe contact surfaces. As will be hereinafter more fully described, the secondary slip assembly 20 is designed to automatically grip the pipe 13 in the event the pipe slips through the primary slip assembly 18. In one embodiment of the system used to run a 13% chrome pipe string, the assembly 20 was a Cavens Model "C" spider with conventional steel, full- circle, slip inserts.

The moveable slip assembly 11, which is illustrated schematically in its closed condition, includes a primary slip assembly 34 and a secondary slip assembly 35. The primary assembly 34 includes smooth surface slips 36 and the lower assembly 35 includes toothed slips 37. In operation and basic construction, the assembly 11 is similar to the assembly 12. The dies in slips 36 of the primary moveable slip assembly 34 are smooth, tooth-free elements similar to the dies 26–29 of the stationary assembly 18. The dies in slips 37 are conventional toothed dies similar to the dies used in the stationary slip assembly 20. The assembly 11 may be constructed of stacked assemblies such as illustrated for the assembly 12 or may be constructed of a single structure having two separate bowl sections as schematically illustrated in FIG. 1.

Although not specifically illustrated herein, it will be understood that the slips of the assemblies 18, 20, 34, and 35 may be manually operated between open and closed positions or may be operated between such positions with the use of hydraulic or air control systems. The construction and operation of such operating methods and controls are well known in the art.

In a typical pipe "running-in", operation in which pipe is being run into the well, the stationary assembly 12 holds and supports the string 13 while the movable assembly 11 is used to pick up and place a single joint of pipe (not illustrated) at the top of the string 13. After the newly added joint is screwed into the top of the string, the slips 36 of the movable assembly 11 are set to grip the top of the new joint and the slips 37 are then closed. The block is raised slightly to raise the joint and attached string 13 to take the string weight off of the stationary slip assembly 18. Once the string weight is removed, the slips 18 and 20 of the assembly 12 are opened and the movable slips 11 and gripped string 13 are lowered into the position illustrated in FIG. 1. The stationary assembly 12 is set by first setting the slips 18 and then resting the string weight on the slips 18. The slips 20 are then closed. Because the weight of the string is being supported by the primary slips assembly 18, there is no downward pipe force acting on the slips of the secondary assembly 20 to cause the slip dies to bite into the pipe. After the two slip assemblies 18 and 20 are respectively set and closed, the movable slip assembly 11 may release the string 13 to pick up another single joint and repeat the "running in" process. The described process is repeated until the entire string has been lowered into the well.

Pulling or removing the pipe string from the well is a similar procedure, run in reverse. Thus, the slips of the stationary assembly 12 are open as the slips 36 of the moveable assembly 11 grip and move the string to pull one joint above the stationary assembly. The slips 18 and then 20 of the stationary assembly 12 are respectively set and closed, the entire string weight is rested on this stationary assembly 12, and the slips 37 and then 36 of the movable assembly 35 are respectively opened and unset to release the pipe. The top joint is unscrewed from the string and the movable assembly is lowered to grab the new top of the string. The movable assembly grips the string 13 and lifts the string up slightly and the stationary assembly is opened once the string weight is taken by the movable slip assembly. The described procedure is repeated for each joint until the entire pipe string is removed from the well.

In the described method of operating the slips of the stationary and moveable assembly, it will be understood that the slips in either assembly may be released from the pipe after the string weight has been taken by the other assembly. The setting procedure uses the closing of the slips as well as the application of string weight to produce the force required to grip and hold the string. Preferably, the toothed-die slips are set, or moved into position between the bowl and the pipe in preparation to being set, after the smooth die slips have firmly gripped and are independently holding the string stationary. The amount of force exerted by the toothed die against the pipe when the conventional slips are closed and set is sufficient to cause the toothed die to move downwardly in the event the pipe slips down but is not great enough to produce any penetration or other damaging marking on the pipe under normal situations where there is no slippage of the pipe through the smooth dies.

From the foregoing, it will be appreciated that the pipe gripping system and method of the present invention provides a safe and efficient procedure for running and pulling fragile pipe strings. Conventional slip and elevator designs may be employed in combination with unique, smooth-surface slip dies to grip and hold the pipe strings without damage to the pipe surface. In a preferred embodiment, the smooth surface dies are constructed of a relatively soft material as compared to the material of the pipe. The danger of string loss is prevented by employing conventional slip assemblies with toothed slip dies as secondary gripping and holding assemblies that actuate only when slippage of pipe through the set primary slip assembly occurs.

As used herein, the terms smooth and non-smooth are intended to be comparative terms that distinguish the primary pipe gripping elements from the backup or secondary pipe gripping elements. It will be understood that the smoothness of the pipe contact area is a matter of degree and that a pipe contact surface with small irregularities is considered "smooth" when compared with the pipe contact surface of conventional pipe dies. The comparative terms used are employed to distinguish the pipe gripping elements as a function of the amount of damage or potential damage each may do to the pipe surface when used as a gripping element. The less smooth the surface, the greater the likelihood of damage. It will also be understood that, while the preferred form of the toothless dies of the present invention have been described as being constructed of an aluminum alloy, other materials may also be advantageously employed, even those which may not be malleable or softer than the pipe which is being handled.

Accordingly, while a preferred embodiment of the system and method of the present invention has been described herein, it will be appreciated that various modifications in the construction and operation of the described system and method may be made without departing from the spirit and scope of the invention.

What is claimed is:

1. A slip assembly for gripping and holding pipe comprising:

a tapered slip bowl having a central axis, a tapered metal slip positioned in said bowl whereby tapered surfaces between said slip and said bowl cause said slip to move radially relative to said central bowl axis as said slip moves axially relative to said bowl;

a pipe contact portion of said slip comprising a smooth pipe contact surface adapted to engage the outer cylindrical surface of a pipe extending axially through said slip bowl, said pipe contact portion being constructed from a material softer than the material of said pipe whereby said pipe contact portion is extruded into the surface irregularities of said pipe as said slip is moved radially into said pipe, and said slip being selectively moveable between a closed set position holding said pipe and preventing axial pipe movement and an open unset position releasing said pipe to permit axial pipe movement.

2. A pipe gripping and holding system comprising:

a primary pipe gripping mechanism, when set, grips and holds an axially extending pipe; and a secondary pipe gripping mechanism, operable when said primary pipe gripping mechanism is set for automatically gripping said pipe when said pipe moves axially through said primary gripping mechanism.

3. A pipe gripping and holding system as defined in claim 2 further comprising a stationary assembly and a moveable assembly, each of said assemblies having said primary and secondary pipe gripping mechanisms whereby said system may run or remove a string of pipe in a well.

4. A first pipe gripping apparatus for gripping and holding an axially extending pipe comprising:

a primary tapered slip bowl adapted to encircle said pipe,

A primary pipe gripping apparatus having first tapered slip elements carried in said primary bowl and adapted to be forced radially inwardly as said first slip elements are moved axially downwardly relative to said primary bowl, and a malleable pipe contact material, softer than the material of said pipe, carried by said first slip elements for engaging and plastically deforming against the surface of said pipe as said first slip elements are moved in a radial direction toward said pipe.

5. A pipe gripping apparatus as defined in claim 4 further comprising:

a secondary pipe gripping apparatus to automatically grip and hold said pipe when said pipe moves through said primary pipe gripping apparatus.

6. A pipe gripping apparatus adapted to encircle and grip an axially extending pipe, comprising:

a tapered slip bowl having a central axis and adapted to encircle and align axially with said pipe, tapered slip elements carried in said slip bowl and adapted to move radially relative to said central bowl axis into engagement with said pipe as said slip elements move axially relative to said bowl, and pipe contact material, softer than the material of said pipe, carried by said slip elements for contacting said pipe and plastically deforming into the surface irregularities of said pipe as said slip elements are forced radially inwardly by axial movement of said slip elements relative to said bowl.

7. A pipe gripping and holding system comprising:

first and second pipe gripping mechanisms for gripping and holding a pipe, smooth pipe contact elements in said first pipe gripping mechanism operable to be set for engaging and holding said pipe to prevent axial pipe movement through said first pipe gripping mechanism, and non-smooth pipe contact elements in said second pipe gripping mechanism automatically operable by pipe movement occurring after said smooth contact elements are set to grip and hold said pipe.

8. A pipe gripping and holding system as defined in claim 7 wherein said smooth contact elements are constructed of a malleable material softer than the material of said pipe.

9. A pipe gripping and holding system as defined in claim 8 wherein said smooth contact elements are constructed of an aluminum alloy.

10. A pipe gripping and holding system as defined in claim 7 further comprising a stationary assembly and a moveable assembly, each of said assemblies having said first and second pipe gripping mechanisms whereby said system may run or remove a string of pipe in a well.

11. A pipe gripping and holding system as defined in claim 10 wherein said smooth contact elements in said stationary assembly and said moveable assembly are constructed of a malleable material softer than the material of said pipe.

12. A method of gripping and holding pipe comprising the steps of:

setting smooth pipe contact elements against a pipe, resting the weight of said pipe on said smooth pipe contact elements, and placing non-smooth pipe contact elements against said pipe whereby said non-smooth pipe contact elements are set to grip and hold said pipe by pipe movement occurring after said smooth pipe contact elements are set.

13. A method as defined in claim 12 wherein said steps are applied by stationary and moveable slip assemblies of a drilling or workover rig.

14. A method as defined in claim 12 further comprising the steps of removing the weight of said pipe from said smooth contact elements and then removing said non-smooth pipe contact elements from said pipe.

15. A method as defined in claim 12 wherein:

said smooth contact elements are smooth die elements in a tapered-bowl slip assembly, and said non-smooth pipe contact elements are toothed die elements in a second tapered-bowl slip assembly.

16. A method as defined in claim 15 further comprising the steps of removing the weight of said pipe from said smooth contact elements and then removing said non-smooth pipe contact elements from said pipe.

17. A pipe gripping and holding system comprising:

first and second pipe gripping mechanisms for gripping and holding a pipe, smooth pipe contact elements in said first pipe gripping mechanism operable to be set for engaging and holding said pipe, non-smooth pipe contact elements in said second pipe gripping mechanism automatically operable by pipe movement occurring after said smooth contact elements are set to grip and hold said pipe, and a stationary assembly and a moveable assembly, each of said assemblies having said first and second pipe gripping mechanism whereby said system may run or remove a string of pipe in a well.

18. A pipe gripping and holding system as defined in claim 17 wherein said smooth contact elements in said stationary assembly and said moveable assembly are constructed of a malleable material softer than the material of said pipe.

19. A method of gripping and holding a pipe comprising the steps of:

setting smooth pipe contact elements against a pipe, resting the weight of said pipe on said smooth pipe contact elements, placing non-smooth pipe contact elements against said pipe whereby said non-smooth pipe contact elements are set to grip and hold said pipe by pipe movement occurring after said smooth pipe contact elements are set, and wherein said steps are applied by stationary and moveable slip assemblies of a drilling or workover rig.

20. A method of gripping and holding a pipe comprising the steps of:

setting smooth pipe contact elements against a pipe, resting the weight of said pipe on said smooth pipe contact elements, placing non-smooth pipe contact elements against said pipe whereby said non-smooth pipe contact elements are set to grip and hold said pipe by pipe movement occurring after said smooth pipe contact elements are set, and removing the weight of said pipe from said smooth elements and then removing said non-smooth pipe contact elements from said pipe.

21. A method of gripping and holding pipe comprising the steps of:

setting smooth pipe contact elements against a pipe, resting the weight of said pipe on said smooth pipe contact elements, placing non-smooth pipe contact elements against said pipe whereby said non-smooth pipe contact elements are set to grip and hold said pipe by pipe movement occurring after said smooth pipe contact elements are set, wherein said smooth contact elements are smooth die elements in a tapered-bowl slip assembly, and said non-smooth pipe contact elements are toothed die elements in a second tapered-bowl slip assembly.

22. A method as defined in claim 21 further comprising the steps of removing the weight of said pipe from said smooth contact elements and then removing said non-smooth pipe contact elements from said pipe.

* * * * *